US006080714A

United States Patent [19]

Overkempe et al.

[11] Patent Number: 6,080,714

[45] Date of Patent: Jun. 27, 2000

[54] SOLID COMPOSITION COMPRISING AN AMPHOTERIC SURFACTANT, A PROCESS FOR ITS PREPARATION, AND THE USE THEREOF

[75] Inventors: Kornelis Overkempe, Holten; Jan Joseph Hubert Ploumen, Roermond, both of Netherlands

[73] Assignee: Akzo Nobel NV, Arnhem, Netherlands

[21] Appl. No.: 08/975,853

[22] Filed: Nov. 21, 1997

[30] Foreign Application Priority Data

Nov. 20, 1997 [EP] European Pat. Off. ..... 97203606

[51] Int. Cl.[7] ..... C11D 1/90; C11D 1/94

[52] U.S. Cl. ..... 510/433; 510/137; 510/445; 510/488; 510/535

[58] Field of Search ..... 510/503, 152, 510/433, 477, 535, 350, 361, 488, 499, 445, 137; 564/298, 297, 299

[56] References Cited

U.S. PATENT DOCUMENTS

| | | | |
|---|---|---|---|
| 3,202,714 | 8/1965 | Zimmerer et al. | 260/584 |
| 4,511,513 | 4/1985 | Guth et al. | 260/404.5 |
| 5,055,233 | 10/1991 | Borland et al. | 252/547 |
| 5,389,306 | 2/1995 | Wierenga et al. | 252/547 |
| 5,399,296 | 3/1995 | Wierenga et al. | 252/547 |

FOREIGN PATENT DOCUMENTS

| | | | |
|---|---|---|---|
| 0 401 503 | 12/1990 | European Pat. Off. | C11D 1/75 |
| 0 421 326 | 4/1991 | European Pat. Off. | C11D 1/75 |
| 0 421 328 | 4/1991 | European Pat. Off. | C11D 1/75 |
| 0 472 320 | 2/1992 | European Pat. Off. | A61K 7/50 |
| 92-49218 | 2/1992 | Japan | A61K 7/06 |
| 1 255 102 | 11/1971 | United Kingdom | C07C 135/02 |
| WO 92/13832 | 8/1992 | WIPO | C07C 291/04 |
| WO 94/17172 | 8/1994 | WIPO | C11D 17/00 |
| WO 97/45514 | 12/1997 | WIPO | C11D 1/65 |

OTHER PUBLICATIONS

*Amphoteric Surfactants,* 2nd. ed., E. G. Lomax, Ed. 1996, Marcel Dekker, pp. 312–313.

*Handbook of Chemistry and Physics,* 58th Edition 1977–1978, CRC Press, pp. D216–D217.

*Abstract,* JO 4049218–A, Feb. 2, 1992.

*Primary Examiner*—Yogendra Gupta
*Assistant Examiner*—Gregory E. Webb
*Attorney, Agent, or Firm*—Ralph J. Mancini; Lainie E. Parker

[57] ABSTRACT

The invention relates to a solid composition comprising a hygroscopic amphoteric surfactant and a fatty acid which is substantially free from other detergents and/or detergent additives. Preferably, the fatty acid is a linear, saturated $C_6$–$C_{22}$ acid. The weight ratio of amphoteric surfactant to fatty acid in said composition preferably is from 4:1 to 1:2. Examples of amphoteric surfactants include amine oxides and betaines. The solid composition of the invention may be shaped into a particulate form, such as granules. The invention further pertains to a process for preparing said composition and to the use of same, for example, in soap bars.

14 Claims, No Drawings

SOLID COMPOSITION COMPRISING AN AMPHOTERIC SURFACTANT, A PROCESS FOR ITS PREPARATION, AND THE USE THEREOF

The present application claims priority of European Patent Application No. 97203606.5 filed on Nov. 20, 1997.

1. Field of the Invention

The invention pertains to a solid composition comprising an amphoteric surfactant, a process for its preparation, and the use of said composition.

2. Background of the Invention

Amphoteric surfactants find application in the preparation of, e.g., soap bars. However, a major drawback to the use of amphoteric surfactants is that most amphoteric surfactants are hygroscopic per se and hence cannot be stored, int. al., in bigbags. A further disadvantage is that hygroscopic amphoteric surfactants have a tendency to form gels during their preparation in aqueous media. It may also be that if a gel is not formed during the preparation, for example because an organic solvent was used, evaporation of the solvent results in the formation of a high-viscous gel. Because of these disadvantages, it has been necessary in the commercial production of amphoteric surfactants to make formulations in a solvent, such as water, and to limit their concentrations to not more than about 30 weight percent, which adds to the cost of shipping. Furthermore, the use of amphoteric surfactants in applications where water addition must be limited, e.g., in soap bars, presents the difficulty of having to remove the water.

In the art, the aforementioned problems have been recognized in, e.g., EP-A-0 421 328. There, the solution was the provision of amphoteric surfactants that are not hygroscopic per se. EP-A-0 421 328 thus discloses a method for making toilet soap bars comprising mixing a trialkylamine oxide dihydrate into a detergent bar formulation. Further, EP-A-0 421 326 teaches a method of preparing transparent soap bars comprising mixing a trialkylamine oxide dihydrate, a fatty acid soap, and optionally other conventional ingredients. EP-A-0 401 503 describes a process for preparing a non-hygroscopic trialkylamine oxide dihydrate and soap bar compositions comprising the same. These documents specifically teach the use of dihydrates of trialkylamine oxides, which compounds are disclosed to be non-hygroscopic per se. However, since hygroscopic amphoteric surfactants are of commercial interest, as indicated above, there is still need for a composition comprising a hygroscopic amphoteric surfactant which does not suffer from the above drawbacks.

The present invention seeks to provide a solid non-hygroscopic composition comprising a hygroscopic amphoteric surfactant which is suitable for storage, shipping, and further processing.

Solid compositions comprising a hygroscopic amphoteric surfactant have been described in the art. For example, EP-A-0 472 320 discloses solid skin cleansing compositions, i.e., toilet soap bars, comprising an acyl isethionate ester salt and a betaine. The formulations disclosed herein comprise from 20 to 70 weight percent of an acyl isethionate ester besides other detergent additives. WO-A-9417172 teaches a soap bar composition comprising a first synthetic anionic surfactant, a second synthetic surfactant selected from a second anionic surfactant, a non-ionic surfactant, an amphoteric surfactant, and mixtures thereof, optionally free fatty acid, optionally soap, and a silicone compound.

The above-mentioned disclosures, however, relate to end-use formulations, more in particular soap bars, whereas the solid composition according to the present invention is an ingredient for the preparation of said end-use formulations and hence does not contain any other detergents, such as a non-hygroscopic surfactant, an acyl isethionate ester or an anionic surfactant, or detergent additives, such as a silicone compound.

JP-A-04049218 describes a coating agent for cosmetics, drugs, and agrochemicals comprising an amphoteric surfactant, a higher fatty acid, and a volatile solvent. It is said that the composite material formed when an aqueous solution of an amphoteric surfactant and a fatty acid are mixed, which is insoluble in water and oil, could cover a surface uniformly only with difficulty, and therefore should be used together with a volatile solvent. We believe this composite material to be a paste and to comprise significant amounts of water. The present invention, on the contrary, pertains to a solid composition which is, moreover, soluble in water.

Non-prepublished International patent application PCT/EP97/02960 discloses a solid composition comprising at least one quaternary ammonium compound and at least one fatty acid compound and a process for the preparation thereof. This document, however, does not relate to amphoteric surfactants, but to cationic surfactants. Unlike amphoteric surfactants, which have anionic and/or cationic properties, cationic surfactants only possess cationic properties.

Processes for making a solid composition comprising a hygroscopic amphoteric surfactant are also known in the art, for example, from WO 92/13832 (preparation of an amine oxide in the presence of a liquefied gas, such as carbon dioxide), GB 1255102 (spray drying of aqueous solutions of amine oxides), and U.S. Pat. No. 5,389,306 and U.S. Pat. No. 5,399,296 (precipitation of an amine oxide with maleic acid). The drawback to these prior art processes, however, is that the obtained solid amphoteric surfactants are hygroscopic. These processes therefore do not provide a solution to the problem of obtaining a solid composition which comprises a hygroscopic amphoteric surfactant but is not itself hygroscopic.

SUMMARY OF THE INVENTION

The present invention generally relates to a solid composition comprising a hygroscopic amphoteric surfactant, characterized in that it comprises a fatty acid and is substantially free from other detergents and/or detergent additives. The present invention further relates to a process for the preparation of said solid composition comprising a hygroscopic amphoteric surfactant of the instant invention.

DETAILED DESCRIPTION OF THE INVENTION

The solid composition of the present invention comprising a hygroscopic amphoteric surfactant is characterized in that it comprises a fatty acid and is substantially free from other detergents and/or detergent additives.

Said composition is non-hygroscopic and hence can be stored, int. al., in bigbags. It has a high active content and thus lower shipping costs than the prior art aqueous formulations. It further is an attractive ingredient for the preparation of end-use formulations such as soap bars, since these bars generally already contain a fatty acid.

The term "amphoteric surfactant" is well-known to the person skilled in the art. It refers to surfactants which, depending on the pH, have anionic and/or cationic properties. They also have an isoelectric point at which they possess a zwitterionic character. In particular, the term refers to compounds having an $N^+$ function in combination with an $O^-$, C(O)OH, $C(O)O^-$, $SO_3H$ or $SO_3^-$ function and to compounds having an N function in combination with a C(O)OH, $C(O)O^-$, $SO_3H$ or $SO_3^-$ function. More in particular, it refers to compounds having an $N^+—O^-$ function, a quaternary $N^+$ function in combination with a $C(O)O^-$, $SO_3H$ or $SO_3^-$ function, and to compounds having a tertiary N function in combination with a C(O)OH, $C(O)O^-$, $SO_3H$ or $SO_3^-$ function. For an overview of amphoteric surfactants and their properties the reader is referred to *Amphoteric Surfactants*, 2nd ed., E. G. Lomax, Ed., 1996, Marcel Dekker. This class of surfactants includes betaines, e.g., fatty alkyl betaines, fatty alkylamido betaines, sulfobetaines, hydroxysulfobetaines, and betaines derived from imidazolines; amine oxides, e.g., fatty alkylamine oxides and fatty alkylamido amine oxides; amphoglycinates and amphopropionates; and so-called "balanced" amphopoly-carboxyglycinates and amphopolycarboxypropionates.

Betaines are a class of amphoteric surfactants which includes compounds having the structures:

$$R^1R^2R^3N^+(CH_2)_yC(O)O^- \quad \text{(I)},$$

and $$(R^1)(R^2C(O)NH(CH_2)_x)(R^3)N^+(CH_2)_yC(O)O^- \quad \text{(II)},$$

wherein $R^1$ is a $C_1$–$C_5$ group which is optionally hydroxylated, such as a methyl, ethyl, hydroxyethyl, or hydroxypropyl group, $R^2$ is a $C_6$–$C_{30}$ group, in particular a linear or branched, saturated or unsaturated $C_6$–$C_{22}$ group, $R^3$ is independently selected from a $C_1$–$C_5$ or $C_6$–$C_{30}$ group as defined for $R^1$ and $R^2$, respectively, x is 2–4, and y is 2–4, and wherein any two of the groups $R^1$–$R^3$ optionally may form a ring structure.

Sulfobetaines and hydroxysulfobetaines are structures according to I and II, having $R^1$, $R^2$, and $R^3$ defined as above, wherein the group $(CH_2)_yC(O)O^-$ has been replaced by a $C_{3-4}—SO_3^-$ group, which $C_3$–$C_4$ group is optionally hydroxylated.

Amine oxides are a class of amphoteric surfactants which includes compounds having the structures:

$$R^1R^2R^3N^+—O^- \quad \text{(III)},$$

and $$(R^1)(R^2C(O)NH(CH_2)_x)(R^3)N^+—O^- \quad \text{(IV)},$$

wherein $R^1$, $R^2$, $R^3$, and x have the meaning described above.

Amphoglycinates (z=1) and propionates (z=2) are a class of amphoteric surfactants which includes compounds having the structures:

$$R^2N(R^4)(CH_2)_zC(O)O^-Y^+ \quad \text{(V)},$$

and $$R^2C(O)N(R^4)(CH_2)_xN(R^5)(CH_2)_zC(O)O^-Y^+ \quad \text{(VI)},$$

wherein $R^2$ and x have the meaning described above, $R^4$ is hydrogen or a $C_1$–$C_5$ group which is optionally hydroxylated, $R^5$ is a $C_1$–$C_5$ group which is optionally hydroxylated or a $(CH_2)_zC(O)O^-$ group, z is 1–4, and $Y^+$ is a cation, such as a proton or a sodium ion.

"Balanced" amphopolycarboxyglycinates (z=1) and propionates (z=2) are a class of amphoteric surfactants which includes compounds having the structure:

$$R^2[N((CH_2)_zC(O)O^-)(CH_2)_x]_nN((CH_2)_zC(O)O^-)_2n+2Y^+ \quad \text{(VII)},$$

wherein $R^2$, x, y, z, and $Y^+$ have the meaning described above, and n is 2–4.

$R^2$ is a $C_6$–$C_{30}$ group, preferably a linear or branched, saturated or unsaturated $C_6$–$C_{22}$ group, more preferably a $C_{10}$–$C_{20}$ group, most preferably a $C_{12}$–$C_{18}$ group. The $C_6$–$C_{30}$ group includes lauryl, myristyl, palmityl, stearyl, and oleyl groups. Using methods known to a person skilled in the art, the $C_6$–$C_{30}$ group may also be derived from naturally occurring fats and oils, such as tallow and coconut oil, palm oil, and palm kernel oil, which contain a mixture of carbon chains (see *Handbook of Chemistry and Physics*, 58th Edition 1977–1978, CRC Press, pages D-216 and D-217). These fats and oils may be hydrogenated or partially hydrogenated.

Typical examples of amphoteric surfactants that can be incorporated into the solid composition according to the present invention include didecyl ethanolamine oxide, dodecyl dimethylamine oxide, tetradecyl dimethylamine oxide, hexadecyl dimethylamine oxide, octadecyl dimethylamine oxide, coco dimethylamine oxide, coco bis(2-hydroxyethyl) amine oxide, dicocomethylamine oxide, dicocoethanolamine oxide, cocoylamidopropyl dimethylamine oxide, tallow dimethylamine oxide, tallow diethanolamine oxide, ditallow methylamine oxide, ditallow ethanolamine oxide, di(hydrogenated tallow) methylamine oxide, tallowylamidopropyl dimethylamine oxide, 9-octadecenoyl dimethylamine oxide, N-cocomorpholine N-oxide, coco dimethylbetaine, cocoylamidopropyl dimethyl betaine, lauroylamidopropyl dimethyl betaine, cocoamphocarboxyglycinate, tallow amphopolycarboxyglycinate, and N-coco-3-aminobutyric acid.

Preferably, the amphoteric surfactant comprised in the composition of the invention is an amine oxide or a betaine.

Within the context of the present invention the term hygroscopic material means that the material in question upon exposure to air humidity becomes less concentrated or, in case of a solid, becomes fluid or forms agglomerates. The hygroscopicity is measured by storing a sample until equilibrium in a climate box at 28° C. and 60% relative humidity and recording the weight increase as a percentage of the starting weight (wt %). The tendency to form agglomerates is tested visually by establishing whether the sample is free flowing or not, or is measured in a so-called caking test cylinder and is expressed as a caking value. A low caking value is desirable for prolonged storage of the amphoteric surfactant composition. The water content of the non-hygroscopic solid composition of the invention is also determined. These methods are explained in the experimental section.

The hygroscopic amphoteric surfactants used in the present invention have a hygroscopicity value above 1, preferably above 2, more preferably above 4, most preferably above 8 wt %. The non-hygroscopic solid composition of the invention has a hygroscopicity lower than 8, preferably lower than 4, more preferably lower than 3, most preferably lower than 2 wt %. The caking value of the solid composition according to the invention is lower than 10, preferably lower than 5, most preferably lower than 3. The water content of the invention composition is lower than 8, preferably lower than 4, most preferably lower than 2 wt %.

The solid composition according to the present invention is substantially free from detergents other than hygroscopic amphoteric surfactants and/or conventional detergent additives. Within the framework of the present invention it is to be understood that the word substantially means that less than 20, preferably less than 10, more preferably less than 8, most preferably less than 5 weight percent, calculated on the total weight of the composition, of such other ingredients is present in the composition of the invention. It is most preferred that the invention composition is essentially free from detergents and detergent additives.

The compostion of the invention may, however, contain impurities such as remaining solvent, starting materials, by-products, etc., which were introduced with the amphoteric surfactant and/or the fatty acid, for example during the preparation of the amphoteric surfactant. Preferably, the amount of hygroscopic amphoteric surfactant plus fatty acid in the composition according to the invention is from 80 to 100 weight percent, more preferably from 90 to 100 weight percent, still more preferably from 95 to 100 weight percent, based on the total weight of the composition. It is most preferred that the composition of the present invention essentially consists of amphoteric surfactant plus fatty acid.

In the solid composition of the present invention any fatty acid can be used in principle. Preferably, the fatty acid is a linear or branched, saturated or unsaturated $C_6$–$C_{30}$ fatty acid, more preferably a $C_6$–$C_{22}$ fatty acid, still more preferably a $C_{10}$–$C_{20}$ fatty acid, most preferably a $C_{12}$–$C_{18}$ fatty acid.

Either a single fatty acid or a mixture of fatty acids can be used. Mixtures of fatty acids can be obtained from naturally occurring fats and oils, such as those described in *Handbook of Chemistry and Physics*, 58th Edition 1977–1978, CRC Press, pages D-216 and D-217. Of these, tallow, coconut oil, palm oil, and palm kernel oil are particularly suitable for use in the invention composition. The fats and oils can be used as such or can be partially or fully hydrogenated, as is known to the person skilled in the art.

Examples of fatty acids suitable for use in the composition according to the invention include octanoic (caprylic) acid, decanoic (capric) acid, dodecanoic (lauric) acid, tetradecanoic (myristic) acid, hexadecanoic (palmitic) acid, octadecanoic (stearic) acid, and mixtures thereof. Mixtures of fatty acids, such as coconut acid, tallow acid, hydrogenated tallow acid, also can be readily used.

The amount of fatty acid used in the composition of the present invention is not critical and can easily be determined by one skilled in the art. It is dependent on the melting point and the hygroscopicity (see the experimental section) of the amphoteric surfactant and the amphoteric surfactant/fatty acid product. Typically, a weight ratio of surfactant to fatty acid in the range of from 5:1 to 1:3, preferably from 4:1 to 1:2, more preferably from 2:1 to 1:1, is used.

Too little added fatty acid will result in a sticky or hygroscopic material which cannot be stored conveniently in, for example, bigbags, whereas too much added fatty acid is economically undesirable in view of the costs of manufacture, storage, and shipping due to the increased volume and weight of the amphoteric surfactant composition.

The solid composition of the present invention can be used as such or, preferably, is shaped into a particulate form. By melting and subsequently cooling the solid composition, flakes, granules, prills, or pastilles may be formed, using an apparatus such as a cooling extruder, granulator, prilling tower, cooling drum, optionally in combination with a sieve granulator, or cooling belt, optionally in combination with a pastillation device. When a cooling drum is employed, a single drum with a feeding roller at the top or a double drum system is preferred. Flakes are preferably crushed in a sieve granulator. The fines may be removed by using a screen. It is preferred to shape the solid composition of the present invention into granules.

The present invention further relates to a process for the preparation of said solid composition comprising a hygroscopic amphoteric surfactant of the instant invention.

The process according to the invention is characterized in that a hygroscopic amphoteric surfactant is contacted with a fatty acid and the product thereof is isolated.

It is not critical when this contacting between the hygroscopic amphoteric surfactant and the fatty acid occurs. It may be achieved by carrying out the preparation of the amphoteric surfactant in the fatty acid or in a mixture of the fatty acid and a solvent, by performing the preparation of the amphoteric surfactant in a solvent and adding the fatty acid after the formation of the amphoteric surfactant is complete, or by mixing the amphoteric surfactant, i.e., the isolated product of an earlier preparation, with the fatty acid and isolating the amphoteric surfactant/fatty acid product.

In one embodiment of the process of the present invention the hygroscopic amphoteric surfactant is prepared in the presence of the fatty acid. For example, a tert-amine can be reacted with a concentrated hydrogen peroxide solution in the presence of a fatty acid to form an amine oxide/fatty acid composition. This specific embodiment has the advantage that due to the addition of the fatty acid and control over the reaction temperature, the reaction mixture does not form a gel and stays stirrable throughout the required reaction time.

Below, this embodiment will be described in more detail using the preparation of an amine oxide from an amine in the presence of a fatty acid as an example. The skilled person will recognize how this can be adapted to other reactions, in particular to other oxidation reactions.

Suitable tert-amines that can be employed in this example of the invention process include compounds having the following structures:

$$R^1R^2R^3N \quad \text{(VIII)},$$

and $$(R^1)(R^2C(O)NH(CH_2)_x)(R^3)N \quad \text{(IX)},$$

wherein $R^1$, $R^2$, $R^3$, and x have the meaning described above.

Preferably, $R^1$ is a methyl or hydroxyethyl group, $R^2$ is a $C_6$–$C_{22}$ group, $R^3$ is a methyl, hydroxyethyl, or $C_6$–$C_{22}$ group, and x is 3. More preferably, $R^1$ is a methyl, $R^2$ is a $C_6$–$C_{22}$ group, and $R^3$ is a methyl or $C_6$–$C_{22}$ group.

The type of fatty acid and the amount of fatty acid relative to the amount of amine oxide to be used in this embodiment of the invention process have been described above.

By concentrated hydrogen peroxide solution is meant, an aqueous peroxide solution containing at least 35 weight percent hydrogen peroxide. Preferably, a hydrogen peroxide solution of from 50 to 75 weight percent is used.

Typically, the amount of hydrogen peroxide utilized is at least the stoichiometric amount with respect to the tert-amine. A small excess of hydrogen peroxide can also be employed. It is undesirable, however, to use too great an excess of hydrogen peroxide, so the amount employed generally is from 1.0 to 1.1 times the stoichiometric amount with respect to the tert-amine used.

As is known for such oxidation processes, it is preferred to combine the reactants at a controlled rate because of the exothermic nature of the reaction. It is generally preferred to maintain contact between the reactants until the reaction is substantially complete, as monitored by analysis of the tert-amine and the hydrogen peroxide, which methods are known to the skilled person. If necessary, an additional amount of either tert-amine or hydrogen peroxide may be added to the reaction mixture.

The temperature at which this embodiment of the process according to the invention is conducted may be any temperature normally employed for such an oxidation reaction. Typically, the temperature used is in the range of 20–100° C. As the reaction progresses, the reaction mixture becomes a gel. This gel formation of course depends on which reactants are reacted at what temperature. In order to keep the reaction mixture liquid, and thereby stirrable, the temperature is increased. Either the reaction is carried out at such a high temperature that the final reaction mixture remains liquid, or the temperature is raised at a controlled rate during the reaction. Starting the reaction at a temperature higher than necessary to keep a liquid reaction mixture has the disadvantage that part of the hydrogen peroxide may decompose before it is able to convert the tert-amine to the corresponding amine oxide. As a consequence, an additional amount of hydrogen peroxide may have to be added. It is therefore preferred to raise the temperature as the reaction proceeds, either stepwise or gradually.

Preferably, the hydrogen peroxide is added at a controlled rate, e.g., in portions or continuously, to a mixture of the fatty acid and the tert-amine, while the temperature is raised as the reaction proceeds.

This embodiment of the invention process may be conducted, if desired, in the presence of a chelating agent which improves the reaction rate, such as diethylene triaminepentaacetic acid or ethylene diaminetetraacetic acid. An amount of from 0.05 to 0.5 weight percent based on the weight of the tert-amine is preferably used. The use of chelating agents in the synthesis of amine oxides from amines is known to the skilled person.

Although it is not required, this embodiment of the invention process is preferably conducted in the presence of an agent known in the art to promote the reaction rate, such as carbon dioxide. Typically, an amount of from 0.01 to 5 weight percent based on the weight of the tert-amine is used.

The reaction mixture at completion of the reaction will contain an amount of water that will vary with the amount and concentration of the hydrogen peroxide use. The water is removed from the reaction mixture. This can be achieved in several ways known to the person skilled in the art, including evaporation, distillation, vacuum stripping, and sparging with an inert gas, such as nitrogen. It is preferred to distill off the water using a film evaporator.

The reaction mixture comprising amphoteric surfactant and fatty acid is subsequently allowed to solidify and, preferably, subsequently shaped into a particulate form as described above.

Another embodiment of the invention process comprises adding the fatty acid to the reaction mixture after the formation of the amphoteric surfactant is complete and before this mixture is worked up. In such a case the amphoteric surfactant may have been prepared in an aqueous or organic solvent-containing medium. In this way, the fatty acid cannot interfere with the preparation of the amphoteric surfactant. It has the advantage that it eases the removal of the solvent(s) from the reaction mixture.

In still another embodiment of the invention process, the isolated product of an earlier preparation comprising the amphoteric surfactant is mixed with the fatty acid, whereupon the amphoteric surfactant/fatty acid product is isolated.

The type and the amount of fatty acid to be used in this embodiment process have been described above. The mixture can be concentrated in a conventional way, for example, by using a film rotary evaporator. The non-hygroscopic solid amphoteric surfactant/fatty acid composition can be isolated and optionally shaped into, for example, granules, as described above.

Suitable starting materials to be used in accordance with this embodiment of the invention process include commercially available aqueous solutions of hygroscopic amphoteric surfactants. Solutions of amphoteric surfactants in organic solvents can also be used. Such solutions may be the isolated reaction products of preparations of amphoteric surfactants in organic solvents, or they may be prepared by evaporation of the solvent from an aqueous solution of the surfactant and subsequent dissolution of the residue in an organic solvent.

This specific embodiment of the invention process was found to be particularly suitable for betaines.

The solid amphoteric surfactant/fatty acid products obtained by the process according to the invention are not hygroscopic. They can be used in many applications such as laundry detergents and personal care products. They are particularly suitable for the manufacture of personal care formulations such as, for example, classic, synthetic and combi soap bars; solid shampoo bars; effervescent bath tablets; shaving soap sticks or creams; deodorant sticks; tooth paste formulations; sun blocks; and lip sticks.

The invention is illustrated by the following examples.

Materials

Farmin DM1214A, coco dimethylamine, 98%, ex Kao Chemicals

Armeen 2M14D, tetradecyl dimethylamine, 98%, ex Akzo Nobel

Armeen SM16D, hexadecyl dimethylamine, 97%, ex Akzo Nobel

Armeen M2HT, octadecyl dimethylamine, 96%, ex Akzo Nobel

Armeen 2MHTD, hydrogenated tallow dimethylamine, 98%, ex Akzo Nobel

Cocoamidopropyl dimethylamine, 98%

Laurylamidopropyl dimethylamine, 98%

Kortacid 1099, capric acid, 99%, ex Akzo Nobel

Kortacid 1299, lauric acid, 99%, ex Akzo Nobel

Kortacid 1499, myristic acid, 99%, ex Akzo Nobel

Kortacid 1895, stearic acid, 95%, ex Akzo Nobel

SMCA, sodium monochloroacetate, ex Akzo Nobel

Hydrogen peroxide, 50% aqueous solution, ex Akzo Nobel $Na_2EDTA$, 99%, ex Akzo Nobel Granule formation The content of the reactor is poured onto trays. The solidifying product is shaped manually into a 1 mm layer using a spatula. The trays were left overnight to complete hardening. The solids were harvested from the plates as flakes. Granules were prepared from the flakes with help of a Frewitt sieve granulator. A screen with an aperture of 1.0 mm was used. The fines were removed using a 355$\mu$ screen or, in case of a cohesive powder, a 500$\mu$ screen, in a shaking apparatus (Retsch, 1.2 mm amplitude). The granules were collected with a yield of at least 65%.

Moisture content and hygroscopicity

The moisture content of samples/granules was determined by weighing an accurate amount of granules (m1) of about 5 g into a 10 cm diameter glass dish. The granules were stored overnight in a dessicator filled with silica gel for drying. The granules were weighed (m2) and the moisture or water content was calculated using the formula $[(m1-m2)/m2]\times100\%$.

The moisture content of liquids and gels was determined by an adapted method in which the weighed granules were mixed with a known amount of sand and were dried in an oven at 105° C.

The hygroscopicity is the moisture content of a sample which has been stored in a climate box (Heraeus oven) at 28° C. and 60% relative humidity until equilibrium.

The samples were tested for their suitability for storage in bigbags. This was determined either visually by establishing that the sample was free flowing or not or by determining a caking value.

Caking value 30 g of a sample were introduced into a caking test cylinder and placed under a load of steel balls simulating the weight of about 1 meter product column. The cylinder was stored for 24 h at 40° C. and then carefully unloaded. The sample was placed on a vibrating screen with an amplitude of 1 mm for 120 seconds. The weight of the residue left behind on the screen after 120 seconds as a percentage of the total weight was determined.

EXAMPLE 1

A reactor equipped with means for stirring, heating, cooling, and vacuum distillation was charged at room temperature with fatty acid (200 g, 1 mole lauric acid), tert-amine (228.8 g, 1.013 moles coco dimethylamine), and $Na_2EDTA$ (0.23 g, 0.1 weight percent based on the tert-amine). The temperature was raised to about 45° C. Carbon dioxide (2.2 g, 5 mole % based on the tert-amine) was then added and after it had dissolved, hydrogen peroxide (70.9 g, 1.043 moles) was added in portions. Concomittantly, the temperature of the reaction mixture was increased stepwise to 70° C. to keep the reaction mixture liquid. After completion of the reaction (about 5 hours) the water was removed by vacuum distillation. The reaction mixture was poured onto a plate and cooled to room temperature, and the resulting solid product was broken up into big flakes.

NMR analysis of the resulting product, i.e., coco dimethylamine oxide/lauric acid, showed 54.4 weight percent (wt %) amine oxide, 44.9 wt % fatty acid, and 0.8 wt % tert-amine. The product was not hygroscopic and free flowing.

EXAMPLES 2–7

Using essentially the same procedure as described in Example 1, the products described in the Examples below were prepared. In each case 1 mole of tert-amine and 1 mole of fatty acid were used. An excess of about 10 mole % hydrogen peroxide was used. The temperature of the reaction mixture was so adjusted as to keep the mixture liquid, i.e., between 70 and 100° C.

EXAMPLE 2

Tetradecyl dimethylamine oxide/capric acid

Analysis: 60.1 wt % amine oxide, 37.9 wt % fatty acid, 2.0 wt % tert-amine, 1.0 wt % moisture content, caking value 3 wt %, 0.4 wt % hygroscopicity.

EXAMPLE 3

Hydrogenated tallow dimethylamine oxide/capric acid

Analysis: 63.9 wt % amine oxide, 32.6 wt % fatty acid, 3.5 wt % tert-amine, 1.2 wt % moisture content, caking value 10 wt %, 2.4 wt % hygroscopicity.

EXAMPLE 4

Tetradecyl dimethylamine oxide/myristic acid

Analysis: 53.2 wt % amine oxide, 42.0 wt % fatty acid, 4.8 wt % tert-amine, 0.6 wt % moisture content, caking value 0 wt %, 0.8 wt % hygroscopicity.

EXAMPLE 5

Hydrogenated tallow dimethylamine oxide/myristic acid

Analysis: 57.2 wt % amine oxide, 38.9 wt % fatty acid, 3.9 wt % tert-amine, 0.8 wt % moisture content, caking value 0 wt %, 1.3 wt % hygroscopicity.

EXAMPLE 6

Tetradecyl dimethylamine oxide/stearic acid

Analysis: 47.7 wt % amine oxide, 49.1 wt % fatty acid, 3.2 wt % tert-amine, 1.2 wt % moisture content, caking value 2 wt %, 0.2 wt % hygroscopicity.

EXAMPLE 7

Hydrogenated tallow dimethylamine oxide/stearic acid

Analysis: 51.7 wt % amine oxide, 45.9 wt % fatty acid, 2.4 wt % tert-amine, 1.2 wt % moisture content, caking value 4 wt %, 0.6 wt % hygroscopicity.

EXAMPLE 8

A glass reactor equipped with means for stirring, heating, cooling, and distilling was charged with 227 parts by weight of octadecyl dimethylamine (0.75 mole), 131 parts by weight of sodium monochloroacetate (1.13 moles), 406 parts by weight of 2-propanol, and 31 parts by weight of water. The temperature was raised to 80° C. while stirring. The pH was kept in the range of 8–9 by means of addition of an aqueous 50%-NaOH solution. A total of 30 parts by weight of alkaline solution were used in this synthesis. The reaction mixture was held at 85° C. for 10 h. The pH was increased to 10–11 after 8 h of reaction. The contents of the reactor was cooled to 60° C. and the pH was reduced to 8–9 using acetic acid. The bulk of the formed NaCl was precipitated by adding 175 parts by weight of 2-propanol and stirring was continued for 2 h at 50° C. The NaCl was removed from the reaction mixture by filtration.

The clear filtrate comprised: 30 wt % octadecyl dimethyl betaine, 60 wt % 2-propanol, 5 wt % water, and 3 wt % sodium glycolate.

Then, 118 parts by weight of the clear filtrate (0.1 mole of betaine) and 28 part by weight of stearic acid (0.1 mole) were mixed. The mixture was heated to 60° C. and the resulting clear liquid was poured onto a cooled plate. The solidified product was dried at room temperature under reduced pressure (100 mbar) for 12 h. The resulting solid was crushed to give a free flowing powder. The powder had low hygroscopicity (1.6 wt %) and stayed free flowing under the conditions of 60% relative humidity/28° C. described above.

EXAMPLES 9–12

Using essentially the same procedure as described in Example 8 the compositions described in the Examples below were prepared.

EXAMPLE 9

Tetradecyl dimethyl betaine/myristic acid

The freshly prepared powder was free flowing and stayed free flowing also after storage at 60% relative humidity/28° C. as described above. The hygroscopicity was 2.5 wt %.

EXAMPLE 10

Hexadecyl dimethyl betaine/palmitic acid

The freshly prepared powder was free flowing and stayed free flowing also after storage at 60% relative humidity/28° C. as described above. The hygroscopicity was 1.0 wt %.

EXAMPLE 11

Cocoamidopropyl dimethyl betaine/palmitic acid

The freshly prepared powder was free flowing and stayed free flowing also after storage at 60% relative humidity/28° C. as described above. The hygroscopicity was 2.6 wt %.

EXAMPLE 12

Laurylamidopropyl dimethyl betaine/palmitic acid

The freshly prepared powder was free flowing and staid free flowing also after storage at 60% relative humidity/28° C. as described above. The hygroscopicity was 3.6 wt %.

Comparative Example A

The same betaine as described in Example 8 was prepared without the addition of fatty acid for comparison. The freshly prepared product was free flowing but became sticky upon storage at 60% relative humidity/28° C. as described above. The hygroscopicity was 13.5 wt %.

Comparative Example B

The same betaine as described in Example 9 was prepared without the addition of fatty acid for comparison. The freshly prepared product was free flowing but became sticky upon storage at 60% relative humidity/28° C. as described above. The hygroscopicity was 28.4 wt %.

Comparative Example C

The same betaine as described in Example 10 was prepared without the addition of fatty acid for comparison. The freshly prepared product was free flowing but became sticky upon storage at 60% relative humidity/28° C. as described above. The hygroscopicity was 13.8 wt %.

Comparative Example D

The same betaine as described in Example 11 was prepared without the addition of fatty acid for comparison. The freshly prepared product was sticky and became a sticky gel upon storage at 60% relative humidity/28° C. as described above. The hygroscopicity was 15.7 wt %.

Comparative Example E

The same betaine as described in Example 12 was prepared without the addition of fatty acid for comparison. The freshly prepared product was free flowing but became sticky upon storage at 60% relative humidity/28° C. as described above. The hygroscopicity was 16.2 wt %.

We claim:

1. A solid composition in the form of particulates comprising an amphoteric surfactant having a hygroscopicity above 1 weight percent, and a fatty acid, said composition being substantially free from other detergents and/or detergent additives, the solid composition being non-hygroscopic and having a hygroscopicity value below 8 weight percent.

2. The composition of claim 1 which comprises from 80 to 100 weight percent of amphoteric surfactant plus fatty acid, based on the total weight of the composition.

3. The composition according to claim 1 wherein the fatty acid is a linear, saturated $C_6$–$C_{22}$ fatty acid.

4. The composition of claim 3 wherein the fatty acid is selected from caprylic acid, capric acid, lauric acid, myristic acid, palmitic acid, and stearic acid, or mixtures thereof.

5. The composition of claim 1 wherein the weight ratio of amphoteric surfactant to fatty acid is from 4:1 to 1:2.

6. The composition of claim 1 wherein the amphoteric surfactant is an amine oxide or a betaine.

7. The composition of claim 1 wherein the composition is shaped into granules.

8. A process for preparing the composition of claim 1 which comprises contacting an amphoteric surfactant having a hygroscopicity above 1 weight percent with a fatty acid, isolating the product which results from said contacting and forming said product into particulates.

9. The process of claim 8 wherein the amphoteric surfactant is prepared in the presence of the fatty acid.

10. The process of claim 9 wherein the amphoteric surfactant is an amine oxide, which is prepared from a tert-amine by reaction with hydrogen peroxide.

11. The process of claim 8 wherein the fatty acid is added to the reaction mixture comprising the amphoteric surfactant after completion of its formation.

12. The process of claim 8 wherein the isolated product of an earlier preparation comprising the amphoteric surfactant is mixed with the fatty acid.

13. The process of claim 12 wherein the amphoteric surfactant is a betaine.

14. A personal care formulations which comprises the composition of claim 1.

* * * * *

UNITED STATES PATENT AND TRADEMARK OFFICE

CERTIFICATE OF CORRECTION

PATENT NO. : 6,080,714
DATED : June 27, 2000
INVENTOR(S) : Kornelis Overkempe, Jan Joseph Hubert Ploumen It is certified that error appears in the above-indentified patent and that said Letters Patent is hereby corrected as shown below:

In column 12, line 43, change "formulations" to --formulation--.

Signed and Sealed this

Third Day of April, 2001

*Attest:*

Nicholas P. Godici

NICHOLAS P. GODICI

*Attesting Officer*

*Acting Director of the United States Patent and Trademark Office*